US008558742B2

(12) United States Patent
Chou et al.

(10) Patent No.: US 8,558,742 B2
(45) Date of Patent: Oct. 15, 2013

(54) MONOPOLE ANTENNA AND ELECTRONIC DEVICE

(75) Inventors: Chen-Yu Chou, New Taipei (TW); Chih-Wei Lee, New Taipei (TW); Chang-Hsin Lai, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 211 days.

(21) Appl. No.: 13/314,150

(22) Filed: Dec. 7, 2011

(65) Prior Publication Data

US 2013/0063312 A1 Mar. 14, 2013

(30) Foreign Application Priority Data

Sep. 14, 2011 (TW) ..... 100217190 U

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS 7,091,908 B2 * 8/2006 Fabrega-Sanchez ... 343/700 MS
8,134,517 B2 * 3/2012 Wang et al. ..... 343/846

* cited by examiner

*Primary Examiner* — Hoang V Nguyen
(74) *Attorney, Agent, or Firm* — Winston Hsu; Scott Margo

(57) ABSTRACT

A monopole antenna for an electronic device includes a grounding element electrically connected to a ground, a radiating element including a first radiator and a second radiator for transmitting and receiving a wireless signal of a first frequency band, a coupling element electrically connected to the second radiator for transmitting and receiving a wireless signal of a second frequency band, and a feed-in element electrically connected between the second radiator of the radiating element and the grounding element for transmitting the wireless signals of the first frequency band and the second frequency band.

14 Claims, 8 Drawing Sheets

| Frequency MHz | Efficiency % | Frequency MHz | Efficiency % | Frequency MHz | Efficiency % | Frequency MHz | Efficiency % |
|---|---|---|---|---|---|---|---|
| 820 | 53 | 1710 | 54 | 1860 | 50 | 2020 | 39 |
| 830 | 53 | 1720 | 55 | 1870 | 50 | 2030 | 41 |
| 840 | 55 | 1730 | 56 | 1880 | 50 | 2040 | 39 |
| 850 | 55 | 1740 | 55 | 1890 | 49 | 2050 | 42 |
| 860 | 54 | 1750 | 57 | 1900 | 46 | 2060 | 44 |
| 870 | 55 | 1760 | 58 | 1910 | 45 | 2070 | 45 |
| 880 | 56 | 1770 | 58 | 1920 | 43 | 2080 | 47 |
| 890 | 50 | 1780 | 57 | 1930 | 41 | 2090 | 48 |
| 900 | 50 | 1790 | 55 | 1940 | 40 | 2100 | 49 |
| 910 | 52 | 1800 | 56 | 1950 | 38 | 2110 | 47 |
| 920 | 54 | 1810 | 56 | 1960 | 38 | 2120 | 47 |
| 930 | 56 | 1820 | 54 | 1970 | 40 | 2130 | 47 |
| 940 | 54 | 1830 | 52 | 1980 | 40 | 2140 | 47 |
| 950 | 55 | 1840 | 52 | 1990 | 39 | 2150 | 48 |
| 960 | 56 | 1850 | 51 | 2010 | 40 | 2160 | 46 |
| | | | | | | 2170 | 46 |

FIG. 3B

MONOPOLE ANTENNA AND ELECTRONIC DEVICE

BACKGROUND OF THE INVENTION

1. Field of the Invention

The present invention relates to a monopole antenna and electronic device adding a coupling element to have enough bandwidth and smaller size.

2. Description of the Prior Art

Due to the prosperous development of wireless communications in recent years, more and more information is transmitted through wireless networks and thus demand for wireless communications increases. Moreover, advances in laptop and pad computer technology also increase requirements for compact products, including reduced size antennas.

In general, a consumer communications device utilizes a dipole antenna or a monopole antenna to perform wireless signal transmission and reception. The dipole antenna is composed of two bent metal lines with a half wavelength of a radiating frequency, but the size is too large for some portable devices and its differential feed-in results in unstable antenna performance. A monopole antenna is derived from the dipole antenna. The monopole antenna has only one metal line as a radiator with the other metal line replaced by a large ground. The large ground forms a mirror effect, so the monopole antenna has an antenna pattern similar to that of the dipole antenna. In such a situation, the monopole antenna has a size smaller than the dipole antenna.

Please refer to FIG. 1, which is a schematic diagram of a traditional monopole antenna 10. The monopole antenna 10 is composed of a radiating element 102 made of a metal line vertically formed on a grounding element 100, and a radio-frequency signal is fed-in to the monopole antenna 10 via a feed-in element 104. The monopole antenna 10 is made by cutting the radiating element 102 to a length equal to a quarter wavelength of the radiating frequency. Due to the simple physical characteristics of the monopole antenna, it is easy to design and has a low manufacturing cost. Hence, the monopole antenna is widely used for the electronic products with wireless communications functionality.

However, the traditional monopole antenna lacks design flexibility because there is only one radiating band centered on the radiating frequency. The traditional monopole antenna requires a size (length) equal to a quarter wavelength of the radiating frequency and decreasing the size within a limited antenna space is difficult. Therefore, finding solutions to the above problem have become a goal of the wireless communications industry.

SUMMARY OF THE INVENTION

It is therefore an object of the present invention to provide a monopole antenna and electronic device.

An embodiment of the invention discloses a monopole antenna, for an electronic device, including a grounding element, electrically connected to a ground, a radiating element, including a first radiator and a second radiator, for transmitting and receiving a wireless signal of a first frequency band, a coupling element, electrically connected to the second radiator of the radiating element, for transmitting and receiving a wireless signal of a second frequency band, and a feed-in element, electrically connected between the second radiator of the radiating element and the grounding element, for transmitting the wireless signals.

An embodiment of the invention further discloses an electronic device, including a monopole antenna including a grounding element, electrically connected to a ground, a radiating element, including a first radiator and a second radiator, for transmitting and receiving a wireless signal of a first frequency band, a coupling element, electrically connected to the radiating element of the second radiator, for transmitting and receiving a wireless signal of a second frequency band, a feed-in element, electrically connected between the radiating element of the second radiator and the grounding element, for transmitting the wireless signals of the first frequency band and the second frequency band, and a radio-frequency processing unit, coupled to the feed-in element of the monopole antenna, for processing the wireless signals of the first frequency band and the second frequency band.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3B is an antenna efficiency diagram corresponding to different operating frequencies of the monopole antenna shown in FIG. 2.

DETAILED DESCRIPTION

Figure 1:
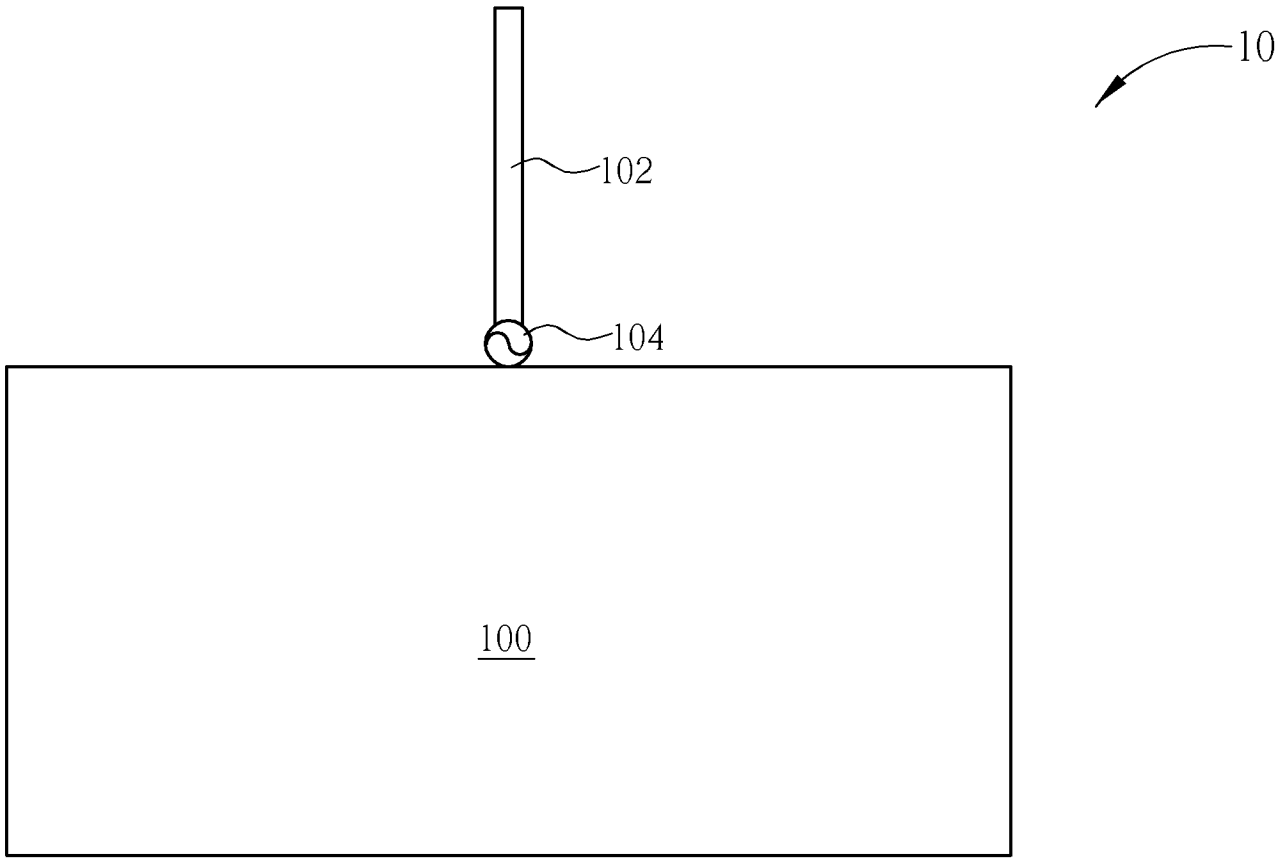
FIG. 1 PRIOR ART
FIG. 1 is a schematic diagram of a traditional monopole antenna.
Figure 2:
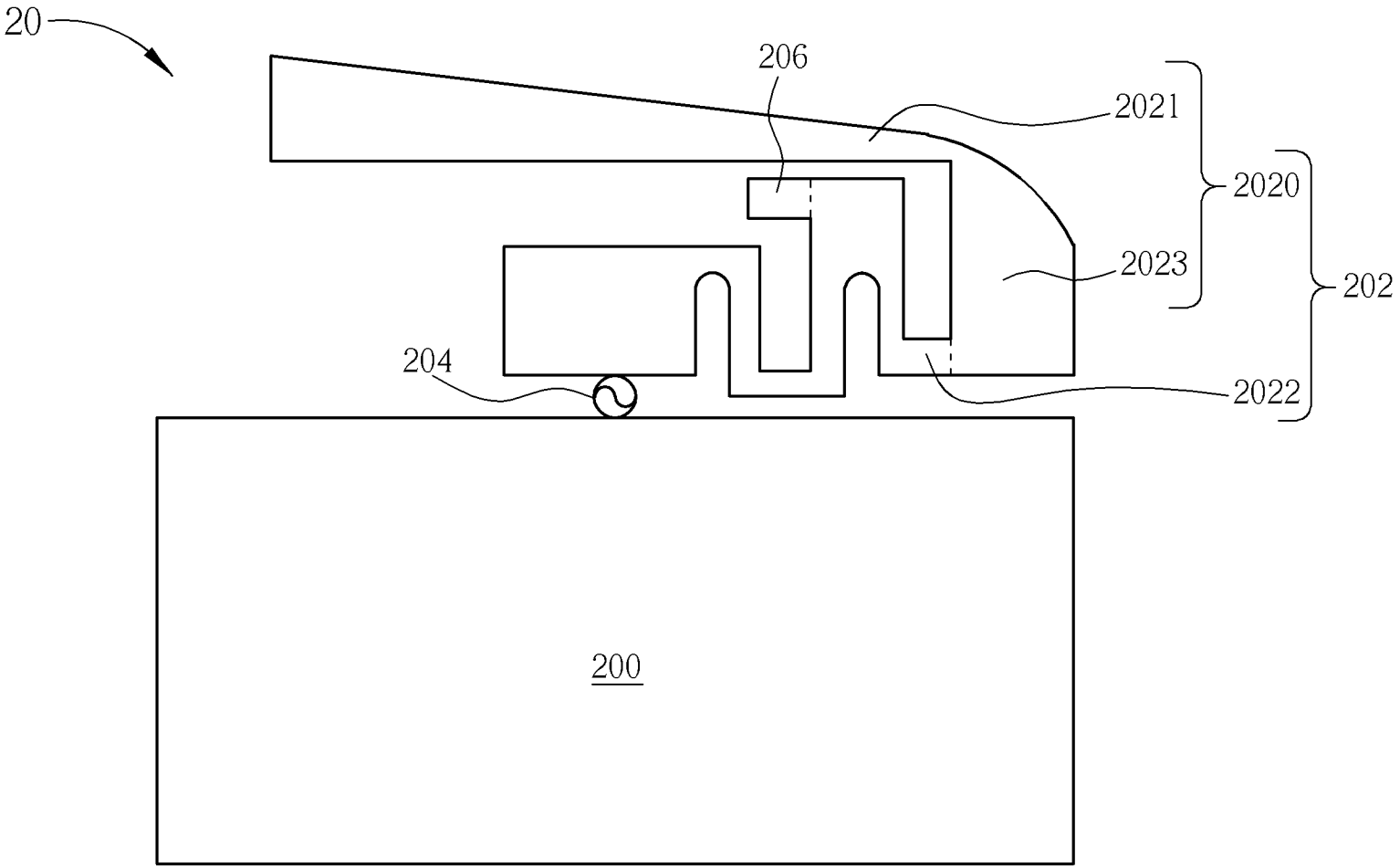
FIG. 2 is a schematic diagram of a monopole antenna according to an embodiment of the invention.

Please refer to FIG. 2, which is a schematic diagram of a monopole antenna 20 according to an embodiment of the invention. The monopole antenna 20 is suitable for electronic products with a wireless communications function, such as a mobile phone, laptop, pad computer or personal digital assistant. The monopole antenna 20 includes a grounding element 200, a radiating element 202, a feed-in element 204 and a coupling element 206. The grounding element 200 is electrically connected to a ground to provide grounding. The radiating element 202 is composed of a first radiator 2020 and a second radiator 2022, for transmitting and receiving wireless signals among two different frequency bands. The coupling element 206 is electrically connected to the second radiator 2022 of the radiating element 202 to generate a coupling effect between the first radiator 2020 and the second radiator 2022, so as to increase a bandwidth and radiating efficiency of the monopole antenna 20 in higher frequency band.

In detail, the first radiator 2020 of the radiating element 202 includes a long side 2021 and a short side 2023, the short side 2023 is electrically connected between the long side 2021 and the second radiator 2022. The long side 2021 is substantially perpendicular to the short side 2023 to surround the second radiator 2022 with an inversed L-shape. The above structure is used for increasing an equivalent capacitance between the first radiator 2020 and the grounding element 200, which allows a current on the monopole antenna 20 to return to the grounding element 200 through the equivalent capacitance, and thus improves the radiating efficiency of the monopole antenna 20.

On the other hand, the second radiator 2022 of the radiating element 202 has a meandering shape, such that the monopole antenna 20 has enough electric length (or current route) to operate in the lower frequency band within a limited space. The coupling element 206 is electrically connected to the second radiator 2022 and extends along a direction parallel to the long side 2021. Since the coupling element 206 is located at a distance equivalent to an electric length required for the high frequency band from the feed-in element 204, the bandwidth and radiating efficiency of the monopole antenna 20 may be improved in the high frequency band.

In short, the monopole antenna 20 utilizes the meandering radiating element 202 to meet the equivalent electric length required for the low frequency band, and adds the coupling element 206 to improve the bandwidth and radiating efficiency in the high frequency band. Thus, the monopole antenna 20 has a small size, and the antenna performance of the monopole antenna 20 is improved both in the high and low frequency bands.

Figure 3A:
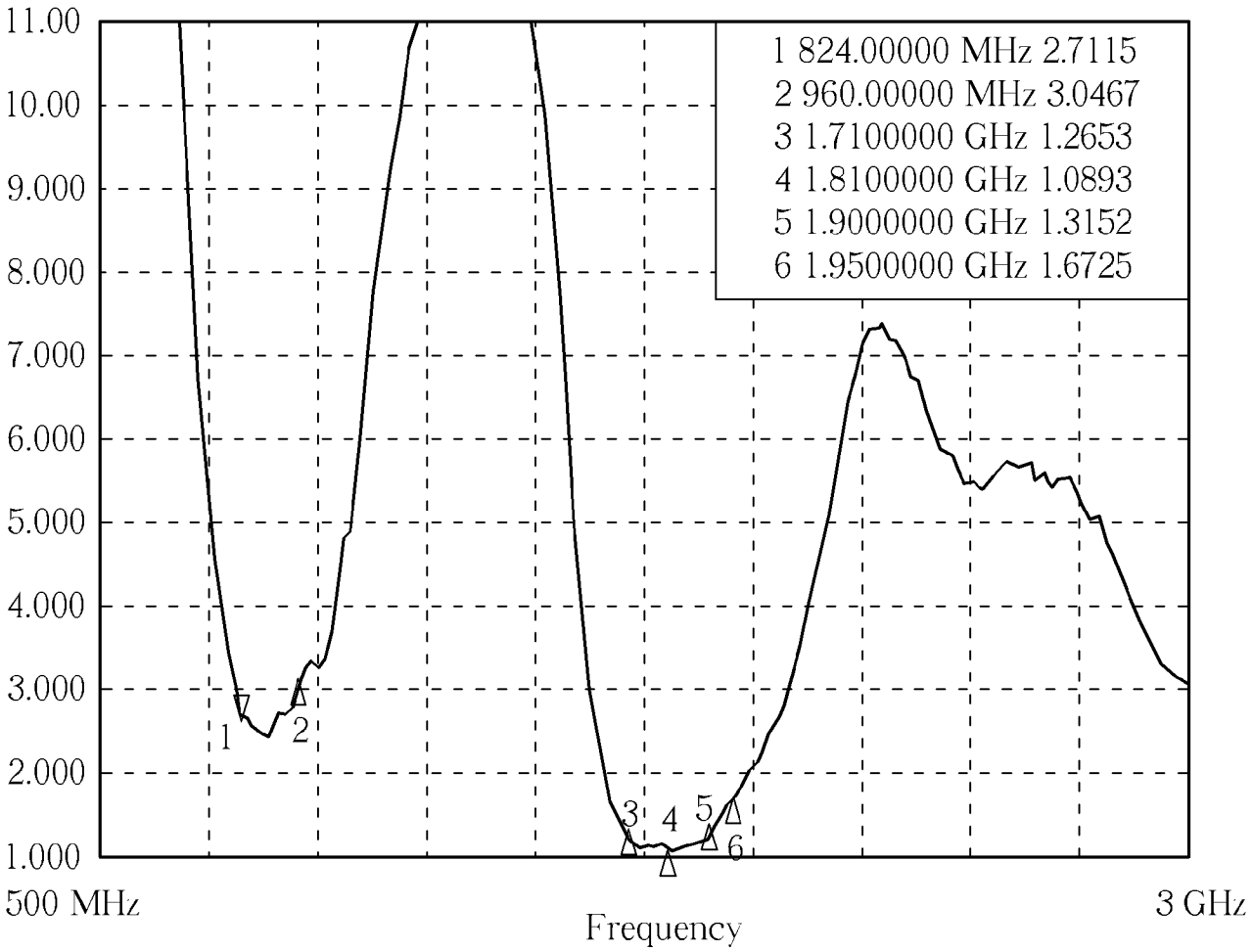
FIG. 3A is a VSWR diagram of the monopole antenna.

FIG. 3A and FIG. 3B illustrate the antenna performance of the monopole antenna 20 shown in FIG. 2. FIG. 3A is a voltage standing wave ratio (VSWR) diagram of the monopole antenna 20; FIG. 3B is an antenna efficiency diagram corresponding to different operating frequencies of the monopole antenna 20. As shown in FIG. 3A, the VSWR of the monopole antenna 20 is less than 3 in the low frequency band, i.e. 824 MHz to 960 MHz; the VSWR is less than 2, which indicates a good matching, in the high frequency band, i.e. 1710 MHz to 1950 MHz. The bandwidth with the VSWR less than 3 is from 1700 MHz to 2100 MHz, and achieves 400 MHz bandwidth. As shown in FIG. 3B, the efficiency of the monopole antenna 20 in the low frequency band is greater than 50%, and greater than 38% in the high frequency band. As can be seen from FIG. 3A and FIG. 3B, the monopole antenna 20 has good matching and radiating efficiency both in the low and high frequency bands.

Therefore, the monopole antenna 20 is meandered appropriately to fit in a limited antenna space, such that the monopole antenna 20 has the electric length equivalent to a quarter wavelength of the radiating frequency band, and a coupling element is added at the position equivalent to the quarter wavelength of the high frequency band, so as to generate a coupling effect to improve antenna matching and radiating bandwidth in the high frequency band. Those skilled in the art could make modifications or alterations accordingly, and the claims are not limited to this. For example, a length of the first radiator 2020 may be extended or shortened, as can be the long side 2021 and the short side 2023; or, numbers of bent corners of the second radiator 2022 may be increased or decreased. By means of extending the length of the first radiator 2020 and increasing the number of bent corners of the second radiator 2022, the equivalent electric length of the monopole antenna 20 is increased, which allows the monopole antenna 20 to operate in a lower frequency band, e.g. the long term evolution (LTE) communication system.

On the other hand, through shortening the length of the first radiator 2020 and decreasing the number of bent corners of the second radiator 2022, the equivalent electric length of the monopole antenna 20 is decreased, which allows the monopole antenna 20 to operate in a higher frequency band, e.g. the wireless local area network (WLAN) and the worldwide interoperability for microwave access (WIMAX) communication systems. In addition, the long side 2021 of the first radiator 2020 may have at least a corner; furthermore, size and material of the monopole antenna 20 are not limited either, which can be changed appropriately to operate indifferent frequency bands and meet practical requirements.

Noticeably, as shown in FIG. 2, edges of the long side 2021 and the short side 2023 have an arc shape, such that an antenna space is well utilized and conforms to a housing of the wireless communications device. In order to improve or maintain the antenna performance within a limited space, widths of the long side 2021 and the short side 2023 may be sculpted to fit within the housing of the wireless communications device. Furthermore, an angle between the long side 2021 and the short side 2023 may be adjusted.

Figure 4:
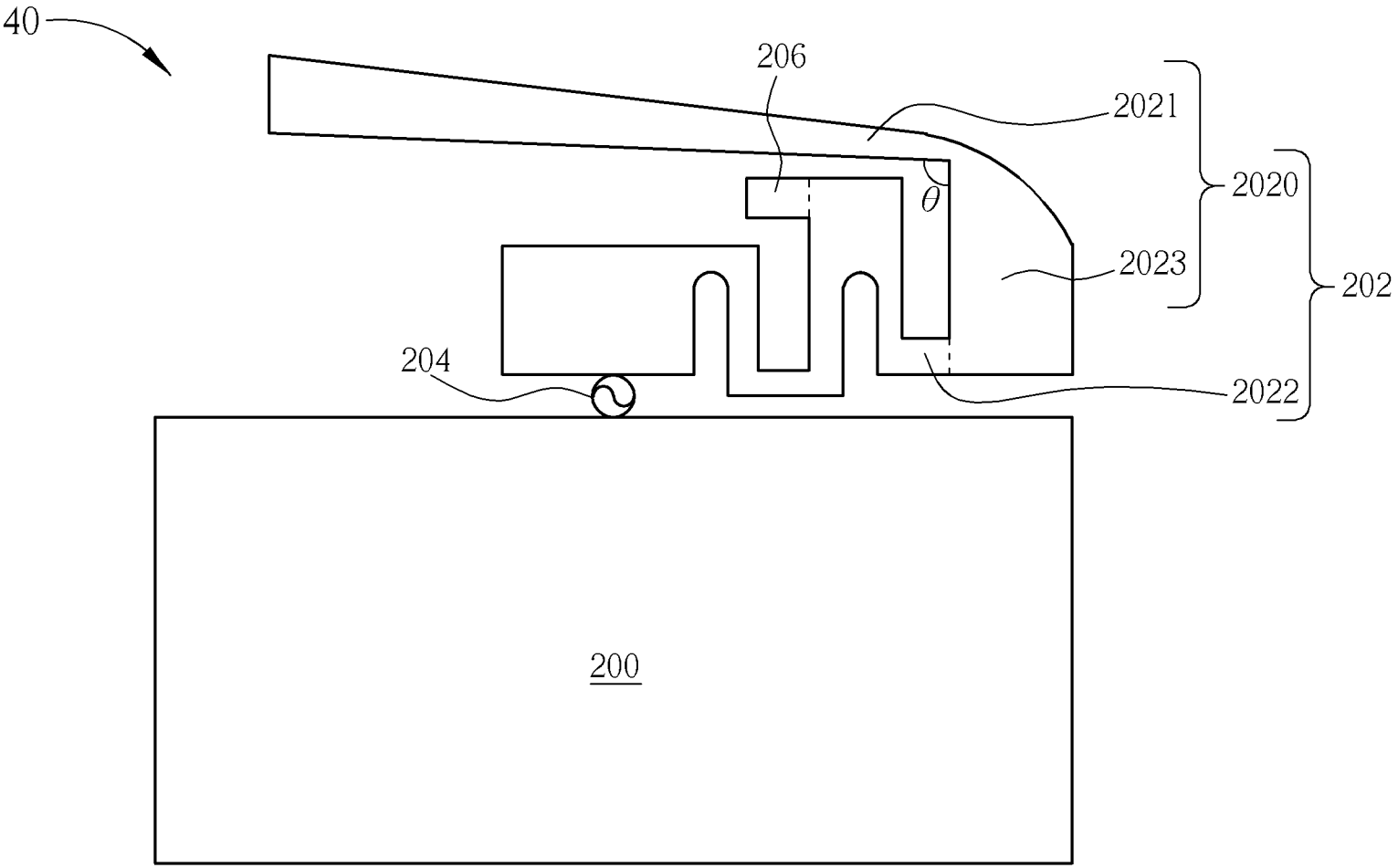
FIG. 4 is a schematic diagram of a monopole antenna according to an embodiment of the invention.

For example, please refer to FIG. 4, which is a schematic diagram of a monopole antenna 40 according to an embodiment of the invention. Since the structure of the monopole antenna 40 is similar to that of the monopole antenna 20, same elements are denoted with the same symbol. One difference between FIG. 4 and FIG. 2 is that an angle θ between the long side 2021 and the short side 2023 is greater than 90 degrees. In such a situation, the shape of the coupling element 206 may be adjusted accordingly to keep the coupling element 206 parallel to the long side 2021, so as to keep the coupling effect between the coupling element 206 and the long side 2021.

Figure 5:
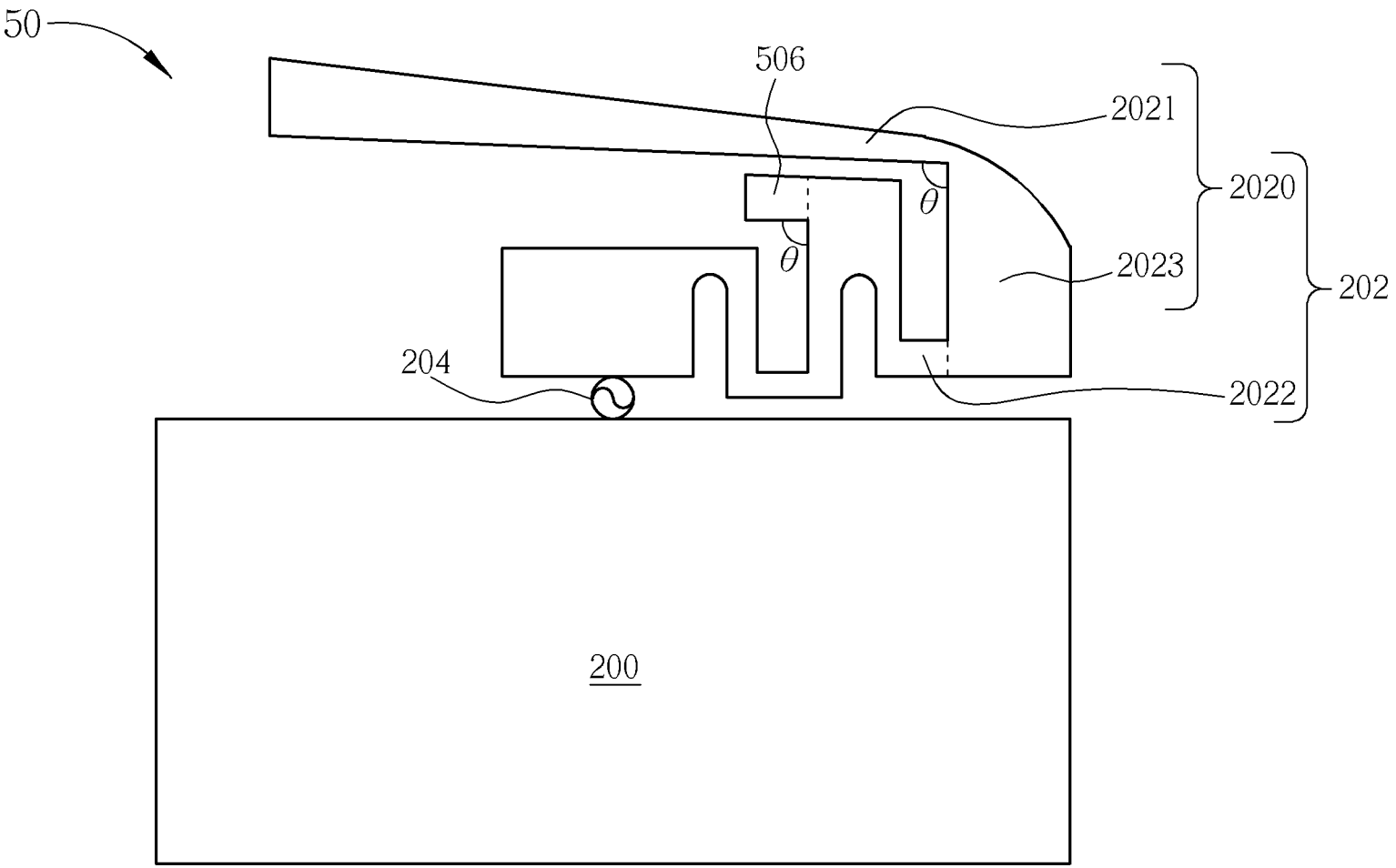
FIG. 5 is a schematic diagram of a monopole antenna according to an embodiment of the invention.

Please refer to FIG. 5, which is a schematic diagram of a monopole antenna 50 according to an embodiment of the invention. As shown in FIG. 5, a coupling element 506 is paralleled to the long side 2021, and has the angle θ with the short side 2023. As a result, the coupling effect between the coupling element 506 and the long side 2021 for high frequency band is maintained, design flexibility of monopole antenna design is increased as well.

Figure 6:
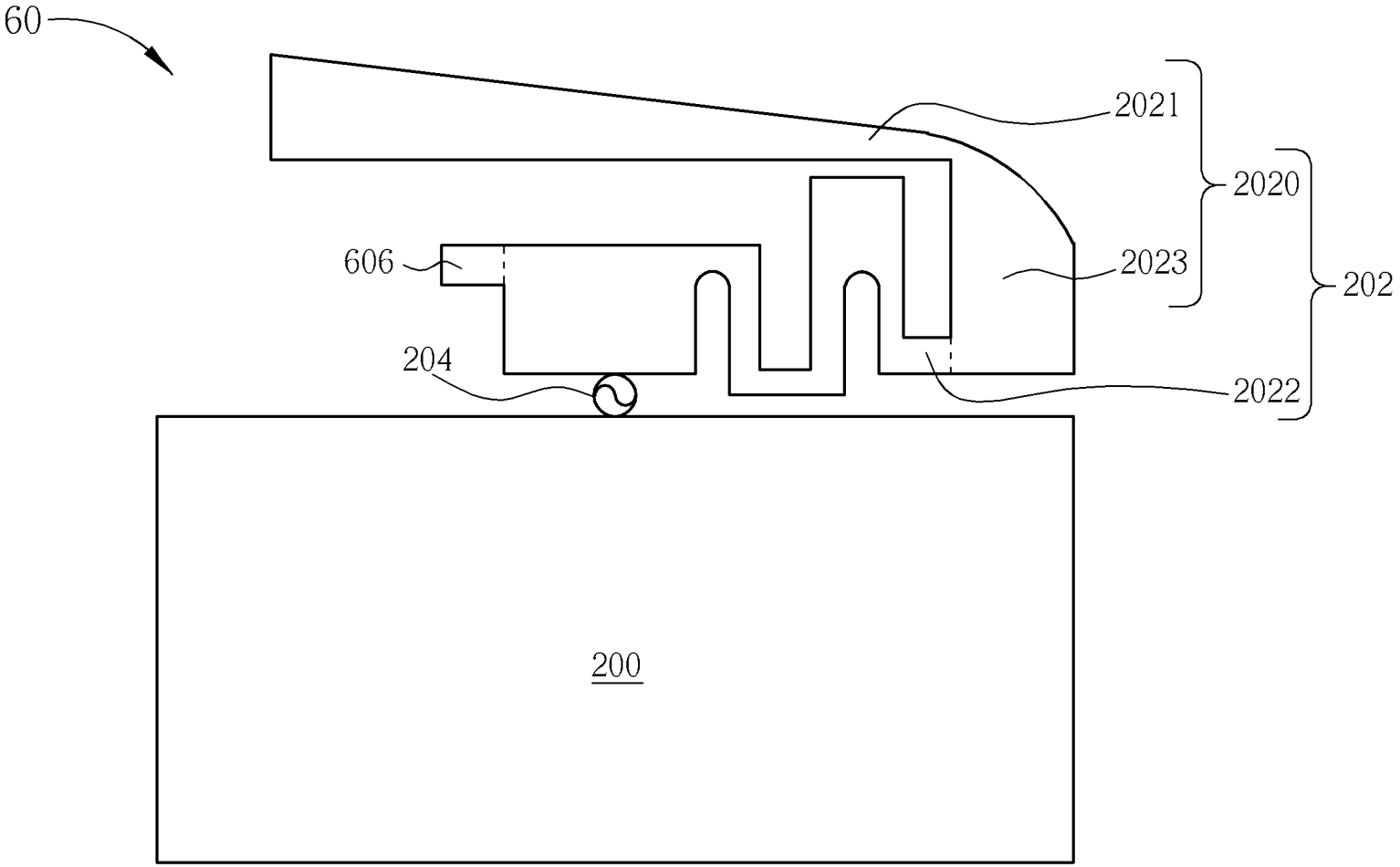
FIG. 6 is a schematic diagram of a monopole antenna according to an embodiment of the invention.

On the other hand, the position where the coupling element 206 is added or coupled is not limited to the position shown in FIG. 2. For example, please refer to FIG. 6, which is a schematic diagram of a monopole antenna 60 according to an embodiment of the invention. Since the structure of the monopole antenna 60 is similar to that of the monopole antenna 20, the same elements are denoted with the same symbol. One difference between FIG. 6 and FIG. 2 is that a coupling element 606 is electrically connected to another corner of the second radiator 2022, such that the coupling effect of monopole antenna 60 is changed in the high frequency band. In other words, adding the coupling element 606 at the position with shorter electric length shifts the operating frequency of the monopole antenna 60 to a higher frequency band, i.e. higher than 1700 MHz. Of course, the number of the coupling elements 206 is not limited, the coupling elements 206, 606 may both exist in the monopole antenna 606 at the same time, and thus a third frequency band may be generated by multiple coupling effects. As a result, the design flexibility of the monopole antenna is improved to meet practical requirements.

Figure 7:
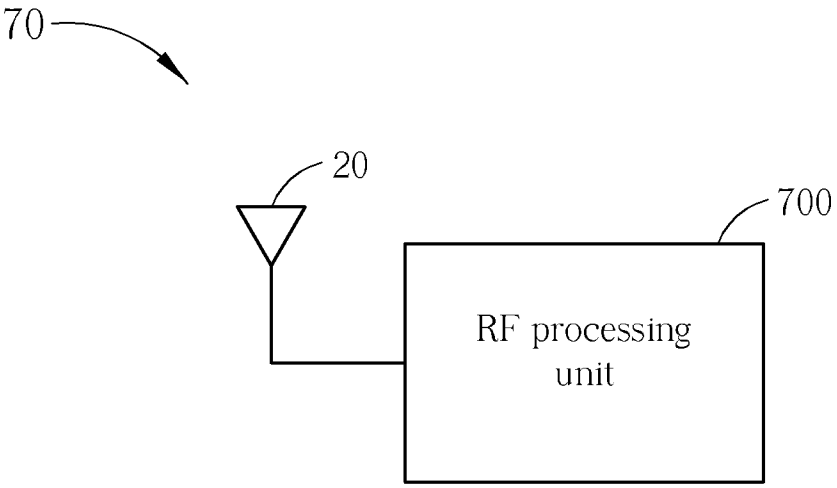
FIG. 7 is a schematic diagram of an electronic device according to an embodiment of the invention.

Thus, in practice, the monopole antenna 20 may be built in an electronic device 70 as shown in FIG. 7. The electronic device 70 may be an electronic product with a wireless communications function, such as a mobile phone, laptop, pad computer or personal digital assistant. The electronic device 70 includes the monopole antenna 20 and a radio-frequency (RF) processing unit 700, the radio frequency processing unit 700 is coupled to the monopole antenna 20, for processing a wireless signal transmitted or received by the monopole antenna 20.

Noticeably, the RF processing unit 700 may perform frequency downgrade, modulation/demodulation or encode/decode to the wireless signal transmitted or received by the monopole antenna 20, or perform processing of the wireless signal with different frequency bands according to practical requirements, such as the wireless wide area network (WWAN), WLAN or WIMAX communication systems. Meanwhile, the antenna characteristics of the monopole antenna 20 may be adjusted to cooperate with the RF processing unit 700. As a result, the electronic device 70 may be utilized in different wireless communications devices. Due to the flexible design of the monopole antenna 20, antenna size may be minimized to meet a trend of small size of the electronic devices.

To sum up, in the prior art, in spite of low cost and simple structure, the traditional monopole antenna lacks design flexibility and is difficult to decrease in size. In contrast, the monopole antenna of the present invention may utilize a meandering radiating element to have a small size, and adds the coupling element to generate the coupling effect in the high frequency band, so as to achieve the required bandwidth in the low and high frequency bands.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A monopole antenna, for an electronic device, comprising:

a grounding element, electrically connected to a ground;

a radiating element, including a first radiator and a second radiator, for transmitting and receiving a wireless signal of a first frequency band;

a coupling element, electrically connected to the second radiator of the radiating element, for transmitting and receiving a wireless signal of a second frequency band; and a feed-in element, electrically connected between the second radiator of the radiating element and the grounding element, for transmitting the wireless signals of the first frequency band and the second frequency band.

2. The monopole antenna of claim 1, wherein the first radiator of the radiating element comprises:

a long side;

a short side, electrically connected between the long side and the second radiator.

3. The monopole antenna of claim 2, wherein the long side is substantially perpendicular to the short side.

4. The monopole antenna of claim 2, wherein widths of the long side and the short side relate to a housing of the electronic device.

5. The monopole antenna of claim 2, wherein the coupling element extends along the long side from the second radiator.

6. The monopole antenna of claim 1, wherein the second radiator of the radiating element conforms to a meander shape.

7. The monopole antenna of claim 1, wherein the second frequency band is greater than the first frequency band.

8. An electronic device, comprising:

a monopole antenna, comprising:

a grounding element, electrically connected to a ground;

a radiating element, including a first radiator and a second radiator, for transmitting and receiving a wireless signal of a first frequency band;

a coupling element, electrically connected to the radiating element of the second radiator, for transmitting and receiving a wireless signal of a second frequency band;

a feed-in element, electrically connected between the radiating element of the second radiator and the grounding element, for transmitting the wireless signals of the first frequency band and the second frequency band; and a radio-frequency (RF) processing unit, coupled to the feed-in element of the monopole antenna, for processing the wireless signals of the first frequency band and the second frequency band.

9. The electronic device of claim 8, wherein the first radiator of the radiating element comprises:

a long side;

a short side, electrically connected between the long side and the second radiator.

10. The electronic device of claim 9, wherein the long side is substantially perpendicular to the short side.

11. The electronic device of claim 9, wherein widths of the long side and the short side relate to a housing of the electronic device.

12. The electronic device of claim 9, wherein the coupling element extends along the long side from the second radiator.

13. The electronic device of claim 8, wherein the second radiator of the radiating element conforms to a meander shape.

14. The electronic device of claim 8, wherein the second frequency band is greater than the first frequency band.

* * * * *